US011363380B2

(12) United States Patent
Chen

(10) Patent No.: US 11,363,380 B2
(45) Date of Patent: Jun. 14, 2022

(54) STEREOPHONIC DEVICES

(71) Applicant: Hewlett-Packard Development Company, L.P., Spring, TX (US)

(72) Inventor: Chieh-Hao Chen, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/048,410

(22) PCT Filed: Jul. 31, 2018

(86) PCT No.: PCT/US2018/044520

§ 371 (c)(1),
(2) Date: Oct. 16, 2020

(87) PCT Pub. No.: WO2020/027794

PCT Pub. Date: Feb. 6, 2020

(65) Prior Publication Data

US 2021/0152940 A1 May 20, 2021

(51) Int. Cl.

| | |
|---|---|
| ***H04R 5/02*** | (2006.01) |
| ***H04R 1/02*** | (2006.01) |
| ***H04R 3/04*** | (2006.01) |
| ***H04S 7/00*** | (2006.01) |

(52) U.S. Cl.

CPC ..... *H04R 5/02* (2013.01); *H04R 1/028* (2013.01); *H04R 3/04* (2013.01); *H04S 7/30* (2013.01); *H04R 2499/15* (2013.01); *H04S 2400/11* (2013.01)

(58) Field of Classification Search

CPC . H04R 5/02; H04R 1/028; H04R 3/04; H04R 249/15; H04S 7/30; H04S 2400/11

See application file for complete search history.

(56) References Cited

U.S. PATENT DOCUMENTS

| | | | | |
|---|---|---|---|---|
| 10,638,227 | B2 * | 4/2020 | Arlbrant | H04R 3/08 |
| 2010/0290643 | A1 | 11/2010 | Mihelich et al. | |
| 2012/0251069 | A1 | 10/2012 | Ikizyan | |
| 2014/0126753 | A1 | 5/2014 | Takumai et al. | |
| 2015/0223002 | A1 | 8/2015 | Mehta et al. | |

(Continued)

FOREIGN PATENT DOCUMENTS

| | | |
|---|---|---|
| EP | 1219140 | 12/2003 |
| EP | 1779509 | 9/2008 |

(Continued)

OTHER PUBLICATIONS

Stedman, Chris; Assignment 1: Technology Review of Dynamic Range Compression, 2012, p. 1 https://www.semanticscholar.org/paper/OF-DYNAMIC-RANGE-COMPRESSION-Stedman/9c7df98e086a8b8b1dd8eec60f76489def1e1693?p2df.

*Primary Examiner* — Andrew L Sniezek
(74) *Attorney, Agent, or Firm* — Fabian VanCott

(57) ABSTRACT

A stereophonic device includes a first speaker to output audio associated with the visual presentation. The output of the first speaker is directed in a direction opposite the visual output of a display device. The stereophonic device includes a servomechanism to adjust an angular direction of an output of a first speaker based on a visual presentation presented on a display device associated with the audio signal to coordinate the output of the first speaker with expected spatial sounds perceived in the visual presentation.

15 Claims, 9 Drawing Sheets

(56) References Cited

U.S. PATENT DOCUMENTS

| | | | | |
|---|---|---|---|---|
| 2017/0150263 | A1 | 5/2017 | Dair | |
| 2017/0201846 | A1* | 7/2017 | Katayama ..... | H04R 5/02 |
| 2018/0184202 | A1* | 6/2018 | Walther ..... | H04R 3/12 |

FOREIGN PATENT DOCUMENTS

| | | |
|---|---|---|
| EP | 2112825 | 10/2009 |
| EP | 2400782 | 12/2011 |
| EP | 1025743 | 6/2013 |
| EP | 2262108 | 3/2017 |
| WO | WO2015035492 | 3/2015 |

* cited by examiner

STEREOPHONIC DEVICES

BACKGROUND

Audio-visual (AV) devices and systems allow users to view and hear AV productions including music, movies, television programs, video conferencing, and other productions that include audio and/or visual presentations. The AV devices may display a visual component of the AV productions on a display device, and the audio component of the AV production may be output to the user via a number of speakers. AV devices and systems are used throughout the world to convey information to and provide entertainment for users.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
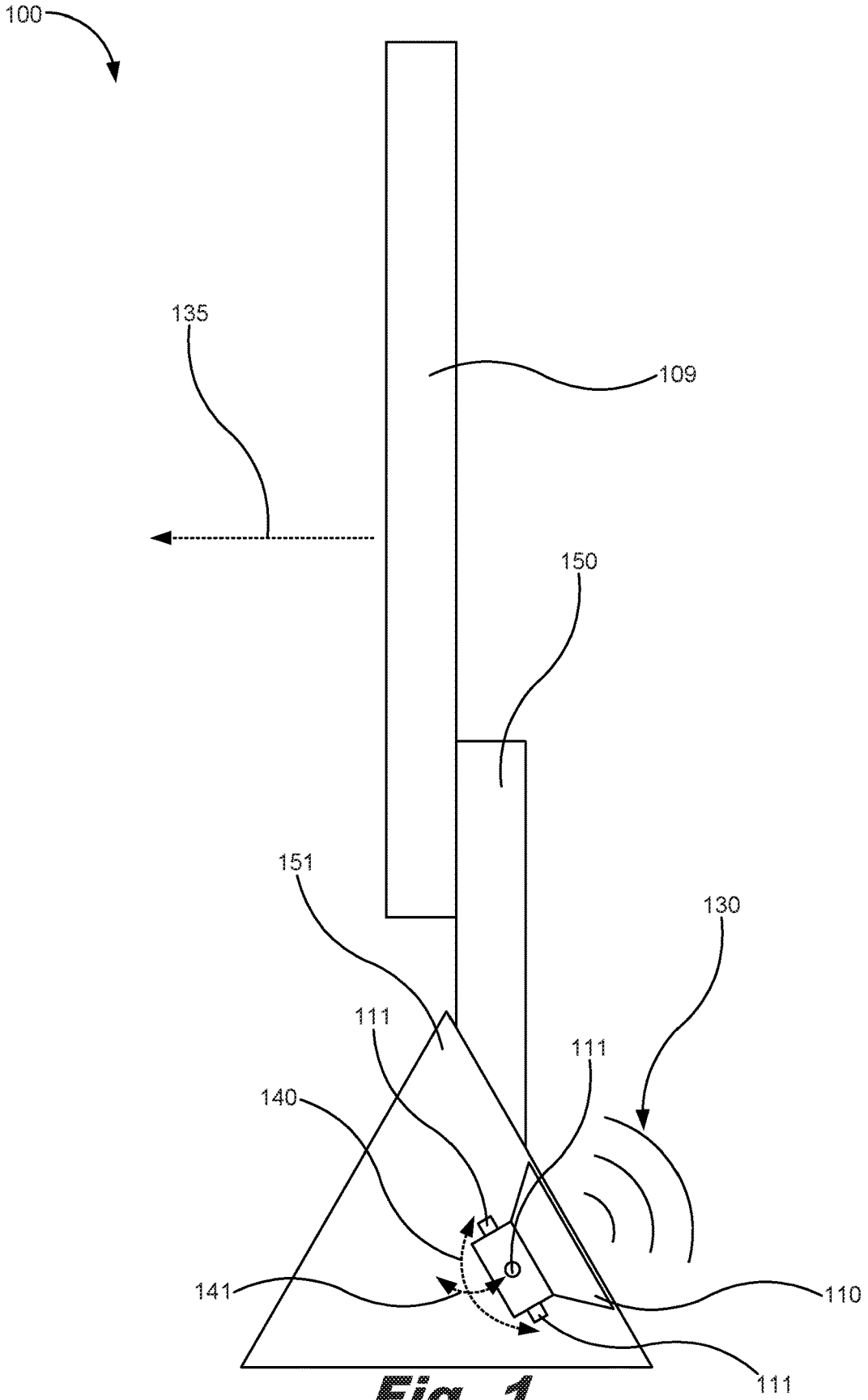
FIG. 1 is a diagram of a stereophonic device, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

AV devices and systems are used to provide a user with audio and visual media for information and/or entertainment purposes. A visual display device such as a television screen, movie screen, computer monitor, or other output device may be used to provide the user with visual images based on a signal input into the device. Further, several audio output devices such as speakers may be used to provide the user with audio that matches or accompanies the visual output presented on the visual display device. In some instances, the audio output devices may be tuned such that the audio output by the audio output devices better matches the visual output of the visual display device or enhances the sounds in some way.

However, in some instances, the sound output by the audio output devices does not have a dimension that matches or is related to the images presented on the visual display device. The audio output devices are stationary, and although they may be enhanced through equalization processes, dynamic range compression, and other audio enhancement processes, the sound produced by the audio output devices may remain two-dimensional with respect to the visual output of the visual display device. In other words, these AV devices and systems do not provide depth and spatial perception of what is being displayed on the visual display device.

Examples described herein provide a stereophonic device. The stereophonic device includes a first speaker to output audio associated with the visual presentation. The output of the first speaker is directed in a direction opposite the visual output of a display device. The stereophonic device includes a servomechanism to adjust an angular direction of an output of a first speaker based on a visual presentation presented on a display device associated with the audio signal to coordinate the output of the first speaker with expected spatial sounds perceived in the visual presentation.

The servomechanism adjusts a vertical angular direction of the output of the first speaker based on the visual presentation presented on the display device associated with the audio signal to coordinate the output of the first speaker with expected vertical spatial sounds perceived in the visual presentation. The stereophonic device also includes a dynamic range compression device to compress the audio signal to gain low levels of the audio signal and increase the overall loudness of the output of the first speaker. Further, the stereophonic device includes an equalizer device to adjust the balance of frequency of the audio signal sent to the first speaker. The stereophonic device also includes at least a second speaker to output a channel of the audio signal different from a channel of the audio signal output by the first speaker.

Examples described herein also provide a stereophonic sound system. The stereophonic sound system includes a computing device. The computing device includes a processor, and a data storage device communicatively coupled to the processor. The stereophonic sound system also includes a display device communicatively coupled to the computing device. The display device, when activated by the processor, displays a visual presentation as it receives a video component from AV data. The stereophonic sound system also includes a first speaker to output audio associated with the visual presentation. The output of the first speaker is directed in a direction opposite the visual presentation of the display device. A number of servomechanisms are also included in the stereophonic sound system to adjust an angular direction of an output of the first speaker based on the visual presentation associated with the audio signal to coordinate the output of the first speaker with expected spatial sounds perceived in the visual presentation.

The stereophonic sound system includes an equalizer device to adjust the balance of frequency of the audio signal sent to the first speaker. Further, the stereophonic sound system includes a dynamic range compression device to compress the audio signal to gain low levels of the audio signal and increase the overall loudness of the output of the first speaker. At least a second speaker may be included in the stereophonic sound system to output a channel of the audio signal different from a channel of the audio signal output by the first speaker. The servomechanism adjusts the angular direction of the output of the first speaker in a vertical angular direction.

Examples described herein also provide a method of tuning a stereophonic sound system. The method may include adjusting an angular direction of an output of a first speaker, tuning output software to optimize the sound output by the first speaker. Tuning the output software may include, with an equalizer device, adjusting the balance of frequency of an audio signal sent to the first speaker, and, with a dynamic range compression device, compressing the audio signal to gain low levels of the audio signal and increasing the overall loudness of the output of the first speaker.

Adjusting the angular direction of the output of the first speaker may include adjusting the vertical angular direction of the output of the first speaker. Adjusting the angular direction of the output of the first speaker may include actuating a servomechanism that moves the first speaker. Further, the method may include adjusting the angular direction of the output of the first speaker based on a visual presentation associated with the audio signal to coordinate the output of the first speaker with expected spatial sounds perceived in the visual presentation. The method may also include, with at least a second speaker, outputting a channel of the audio signal different from a channel of the audio signal output by the first speaker. The stereophonic devices, systems and methods described herein provide greater sound depth and dimension, and provide spatial perception of the audio signal as relates to a video signal of AV data presented via the stereophonic device. Further, the present devices, systems, and systems provide for the adjustment of the vertical and horizontal direction of the sound as presented by both front- and back-facing speakers. In this manner, the spatial perception of the sound output by the speakers may be matched with the visual components to provide a user with a greater sense of realism and immersion in the presentation of the AV data.

Turning now to the figures, FIG. 1 is a block diagram of a stereophonic device (100), according to an example of the principles described herein. The stereophonic device (100) described in connection with FIG. 1 and the other examples described herein provides for the reproduction of an audio output that creates an illusion of multi-directional audible perspective while also providing a three-dimensional (3D) dynamic sound that matches or accompanies the visual output provided by a visual output device (109).

The stereophonic device (100) may include a visual output device such as a display device (109), which may be coupled to a support (150) and a housing (151). An audio output device such as a speaker (110) is housed within the housing (151). Although the display device (109) and speaker (110) are depicted as being physically coupled to one another via the support (150) and the housing (151), the display device (109) and speaker (110) may be separate elements within an audio-visual system.

The speaker (110) outputs audio associated with the visual presentation presented on the display device (109). The output (130) of the speaker (110) is directed in a direction opposite the visual output (135) of the display device (109), and may be referred to as a rear-facing speaker for this reason. As depicted in FIG. 1, the visual output (135) of the display device (109) is to the left. The output (130) of the speaker (110) is to the right as viewed in FIG. 1, and, in this manner, is directed away from the user viewing the output (135) and audibly out the back of the display device (109). The direction of the audio output from the speaker (110) from the opposite side of the display device (109) from the visual output (135) of the display device (109) provides an illusion of multi-directional audible perspective while also providing a 3D dynamic sound.

In one example, the audio output (130) by the speaker (110) may be matched or may accompany the visual output (135) provided by the display device (109). At least one servomechanism (111) may be coupled between the speaker (110) and the housing (151) to adjust at least one angular direction of the output (130) of the speaker (110). Although servomechanisms (111) are described herein as the devices used to move the positioning of the speakers (110), any other types or combinations of devices may be used including, for example, motors, belts, gears, linear actuators, other devices, or combinations thereof.

In one example, the movement of the speaker (110) via the servomechanisms (111) may be based on what is being depicted in the visual output (135) of the display device (109). For example, if the visual output (135) provided by the display device (109) depicts an object or other element towards the top of the display device (109), then the servomechanisms (111) may be used to direct or move the speaker (110) upward, for example, so that the spatial perception of the audio may be matched to the object or other element depicted towards the top of the display device (109) and the spatial perception of the sound reflected by the movement of the speaker (110) upward. Arrow 140 indicates that the servomechanisms (111) are able to adjust the direction of the speaker (110) vertically up and down. In this manner, changes to the orientation of the speaker (110) via the servomechanisms (111) allow for the visual presentation presented on a display device (109) associated with the audio signal to coordinate the output of the speaker (110) with expected spatial sounds perceived in the visual presentation.

Further, FIG. 1 depicts arrow 141 which indicates that the servomechanisms may change the orientation of the speaker (110) in the horizontal direction as well. By adjusting the speaker (110) in the horizontal direction, the audio output (130) by the speaker (110) may be matched to an object or other element depicted in the display device (109) that is spatially expected to be to one side of the display device (109) or the other. In this manner, changes to the orientation of the speaker (110) via the servomechanisms (111) in the horizontal directions allow for the visual presentation presented on a display device (109) associated with the audio signal to coordinate the output of the speaker (110) with expected spatial sounds perceived in the visual presentation in the horizontal directs as well.

Figure 2:
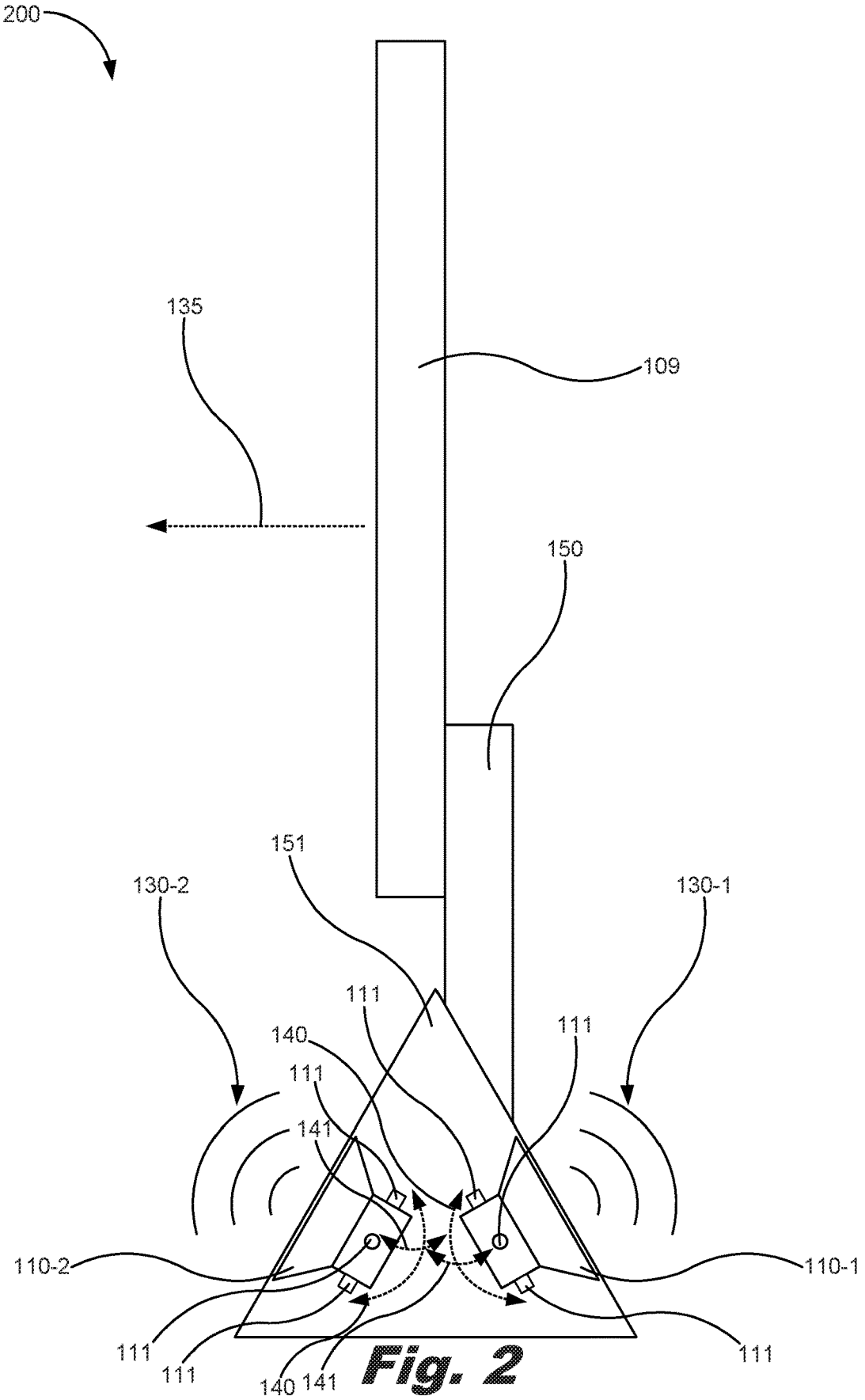
FIG. 2 is a diagram of a stereophonic device, according to an example of the principles described herein.
Figure 3:
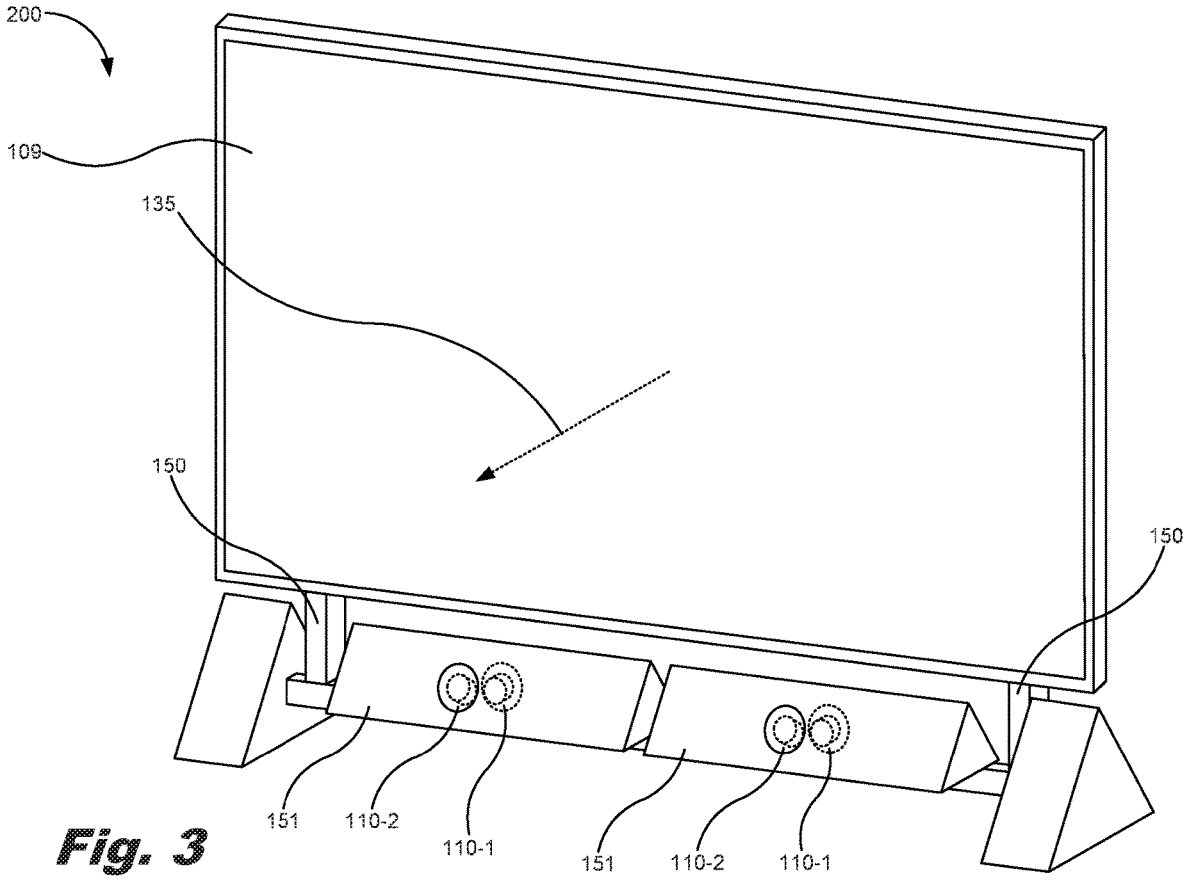
FIG. 3 is a perspective view of a stereophonic device, according to an example of the principles described herein.

FIG. 2 is a diagram of a stereophonic device (200), according to an example of the principles described herein. Further, FIG. 3 is a perspective view of a stereophonic device (200), according to an example of the principles described herein. The stereophonic device (200) of FIG. 2 includes similar elements as the stereophonic device (100) of FIG. 1, and description of these elements is provided herein in connection with FIG. 1. The stereophonic device (200) of FIG. 2 further includes a front facing speaker (110-2) in addition to the rear-facing speaker (110-1). Like the first, rear-facing speaker (110-1), the second, front-facing speaker (110-2) may be moved in the vertical and horizontal direction using servomechanisms (111) to match or coordinate the visual presentation presented on a display device (109) associated with the audio signal with the output of the speaker (110) with expected spatial sounds perceived in the visual presentation. In this manner, the sound provided by the first, rear-facing speaker (110-1) and the second, front-facing speaker (110-2) will be more realistic and immersive compared to an AV system that employs just a front-facing speaker. This is due to the inclusion of the rear-facing speaker (110-1) which provides a depth to the overall sound, and is also due to the ability to move the speakers (110-1, 110-2) using the servomechanisms (111)

that allow the movement of objects depicted in the visual presentation of the display device (109) to be matched or coordinated with the positioning of the sound produced by the speakers (110-1, 110-2). This provides the user with a more immersive experience where the output sound (130-1, 130-2) of the respective speakers (110-1, 110-2) is perceived as three-dimensional.

In one example, the first, rear-facing speaker (110-1) and the second, front-facing speaker (110-2) may output different channels of sound. In surround sound systems, different channels of sound may be output by different speakers. In one example, the first, rear-facing speaker (110-1) may output a bass channel and may acts as a subwoofer speaker while the second, front-facing speaker (110-2) may output a treble channel and may act as a tweetter. Further, the first, rear-facing speaker (110-1) and the second, front-facing speaker (110-2) may operate along with additional speakers to form a more complex surround sound system including the International Telecommunication Union's (ITU's) surround sound standards of 5.1, 7.1, 10.2, 11.1, and 22.2 as well as sonic whole overhead sound produced by Dolby Laboratories, abisonics, binaural sound effects, and panorambiophonic effects, among other surround sound specifications. The example depicted in FIG. 3 includes two sets of first, rear-facing speakers (110-1) and the second, front-facing speakers (110-2) to provide auditory symmetry in the sound produced by these speakers. In one example, the first, rear-facing speaker (110-1) and the second, front-facing speaker (110-2) may output the same channel of sound.

Figure 4:
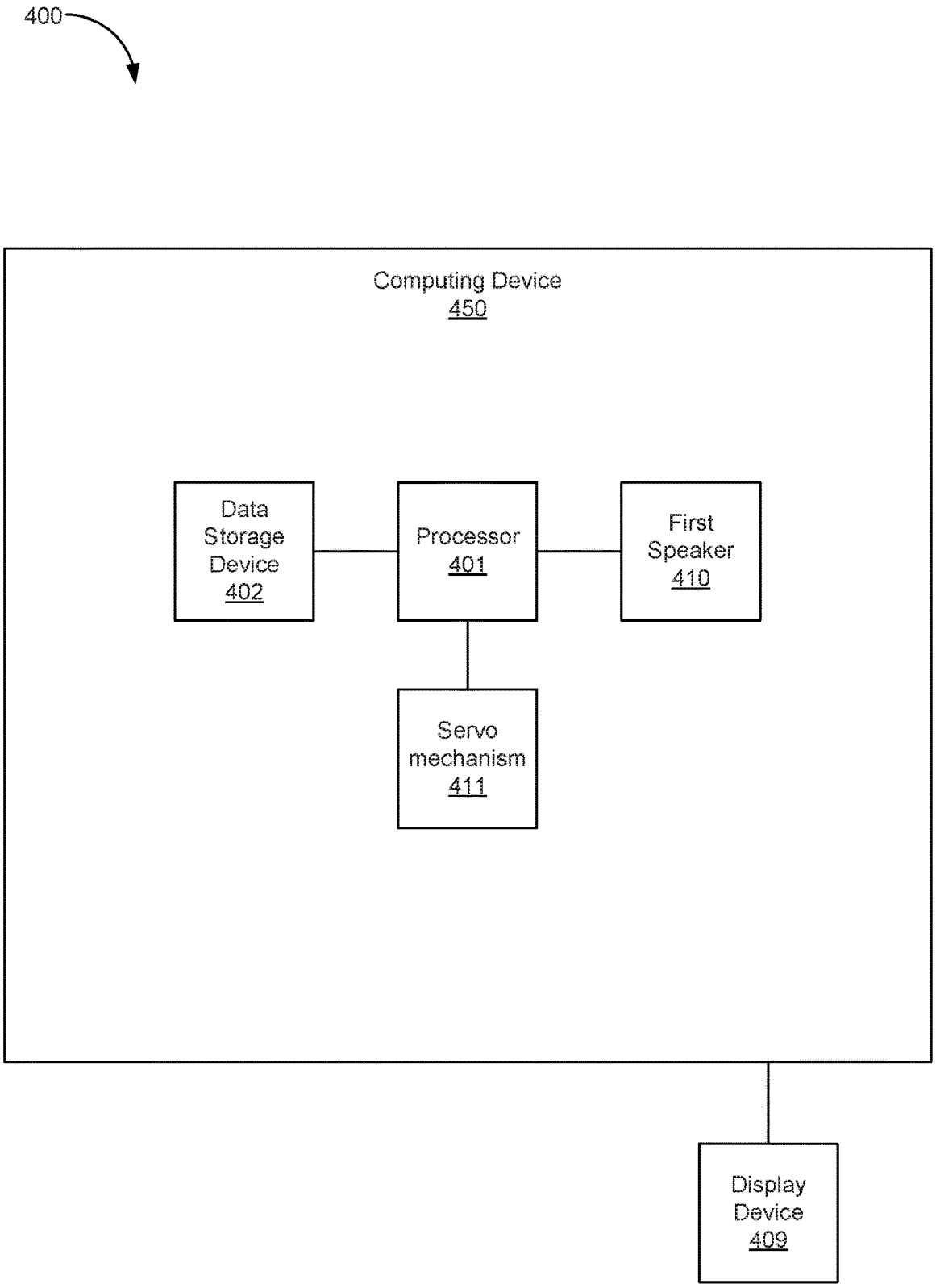
FIG. 4 is a block diagram of a stereophonic sound system, according to an example of the principles described herein.

FIG. 4 is a block diagram of a stereophonic sound system (400), according to an example of the principles described herein. The stereophonic sound system (400) may include a computing device (450). The computing device (450) may include a processor (401) and a data storage device (402) communicatively coupled to the processor (401). The stereophonic sound system (400) may also include a display device (401) communicatively coupled to the computing device (450). The display device (409), when activated by the processor (401), displays a visual presentation. A first speaker (410) may be included in the computing device (450) itself or as a separate device outside the computing device (450). As described herein, the first speaker (410) outputs audio associated with the visual presentation provided by the display device (409). The output of the first speaker (410) is directed in a direction opposite the visual presentation of the display device (409). Further, a number of servomechanisms (411) may be physically coupled to the first speaker (410) and communicatively coupled to the processor (401), and may be used to adjust an angular direction of an output (130-1) of the first speaker based on the visual presentation associated with the audio signal to coordinate the output of the first speaker with expected spatial sounds perceived in the visual presentation.

Figure 5:
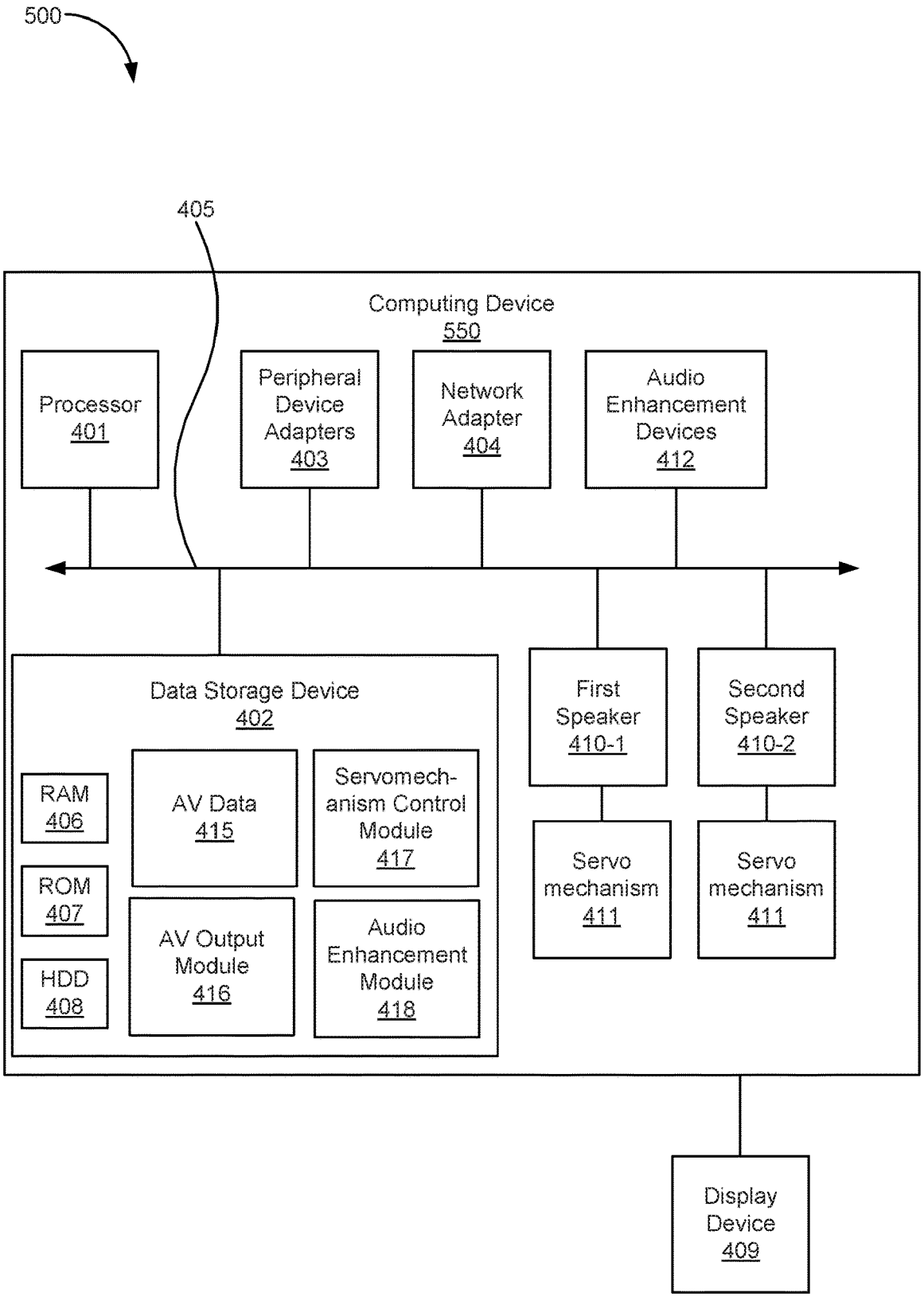
FIG. 5 is a block diagram of a stereophonic sound system, according to an example of the principles described herein.

FIG. 5 is a diagram of a stereophonic sound system (500), according to an example of the principles described herein. Similar elements included in the stereophonic sound system (500) of FIG. 5 are also provided in connection with the stereophonic sound system (400) of FIG. 4. The stereophonic sound system (500) may include a computing device (550). The computing device (550) may be implemented in an electronic device. Examples of electronic devices include servers, desktop computers, laptop computers, personal digital assistants (PDAs), mobile devices, smartphones, gaming systems, and tablets, among other electronic devices.

The computing device (550) may be utilized in any data processing scenario including, stand-alone hardware, mobile applications, through a computing network, or combinations thereof. Further, the computing device (550) may be used in a computing network, a public cloud network, a private cloud network, a hybrid cloud network, other forms of networks, or combinations thereof. Further, the present systems may be implemented on one or multiple hardware platforms, in which the modules in the system can be executed on one or across multiple platforms.

To achieve its desired functionality, the computing device (550) includes various hardware components. Among these hardware components may be a number of processors (401), a number of data storage devices (402), a number of peripheral device adapters (403), a number of network adapters (404), audio enhancement devices (412), a first speaker (410-1), a second speaker (410-2), and servomechanisms (411). These hardware components may be interconnected through the use of a number of busses and/or network connections. In one example, these hardware components may be communicatively coupled via a bus (405).

The processor (401) may include the hardware architecture to retrieve executable code from the data storage device (402) and execute the executable code. The executable code may, when executed by the processor (401), cause the processor (401) to implement at least the functionality of adjusting an angular direction of an output of the first speaker (410-1) and the second speaker (410-2), tuning output software to optimize the sound output by the first speaker (410-1) and the second speaker (410-2), and outputting various channels of an audio signal to the first speaker (410-1) and the second speaker (410-2), and other processes according to the methods of the present specification described herein. In the course of executing code, the processor (401) may receive input from and provide output to a number of the remaining hardware units.

The data storage device (402) may store data such as executable program code that is executed by the processor (401) or other processing device. As will be discussed, the data storage device (402) may specifically store computer code representing a number of applications that the processor (401) executes to implement at least the functionality described herein.

The data storage device (402) may include various types of memory modules, including volatile and nonvolatile memory. For example, the data storage device (402) of the present example includes Random Access Memory (RAM) (406), Read Only Memory (ROM) (407), and Hard Disk Drive (HDD) memory (408). Many other types of memory may also be utilized, and the present specification contemplates the use of many varying type(s) of memory in the data storage device (402) as may suit a particular application of the principles described herein. In certain examples, different types of memory in the data storage device (402) may be used for different data storage needs. For example, in certain examples the processor (401) may boot from Read Only Memory (ROM) (407), maintain nonvolatile storage in the Hard Disk Drive (HDD) memory (408), and execute program code stored in Random Access Memory (RAM) (406).

The data storage device (402) may include a computer readable medium, a computer readable storage medium, or a non-transitory computer readable medium, among others. For example, the data storage device (402) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain or store a program for use by or in connection with an instruction execution system, apparatus, or device.

The hardware adapters (403, 404) in the computing device (550) enable the processor (401) to interface with various other hardware elements, external and internal to the computing device (550). For example, the peripheral device adapters (403) may provide an interface to input/output devices, such as, for example, display device (409), a mouse, or a keyboard. The peripheral device adapters (403) may also provide access to other external devices such as an external storage device, a number of network devices such as, for example, servers, switches, and routers, client devices, other types of computing devices, and combinations thereof.

In one example, the display device (409) may be provided to allow a user of the computing device (550) to interact with and implement the functionality of the computing device (550). Further, the display device (409), as described herein, is used to output a video component of audio-visual (AV) data (415). The display device (409) may be any device that is used to output information in visual form. For example, the display device (409) may include a cathode ray tube display (CRT), a light-emitting diode display (LED), and electroluminescent display (ELD), electronic paper, a plasma display panel (PDP), a liquid crystal display (LCD), a high-performance addressing display (HPA), a thin-film transistor display (TFT), an organic light-emitting diode display (OLED), a digital light processing display (DLP), a 3D display device, other types of display devices, and combinations of these technologies.

The peripheral device adapters (403) may create an interface between the processor (401) and the display device (409), a printer, or other media output devices. The network adapter (404) may provide an interface to other computing devices within, for example, a network, thereby enabling the transmission of data between the computing device (550) and other devices located within the network.

The computing device (550) further includes a number of modules used in the implementation of the processes and functionalities described herein. The various modules within the computing device (550) include executable program code that may be executed separately. In this example, the various modules may be stored as separate computer program products. In another example, the various modules within the computing device (550) may be combined within a number of computer program products; each computer program product including a number of the modules. For example, the computing device (550) may include an AV output module (416) to, when executed by the processor (401), output visual components of the AV data (415) to the display device (409) and output audio components of the AV data (415) to the first, rear-facing speaker (410-1) and the second, front-facing speaker (410-2). The AV output module (416) may also separate the audio components of the AV data (415) for output by the first, rear-facing speaker (410-1) and the second, front-facing speaker (410-2) into different channels such that the first, rear-facing speaker (410-1) and the second, front-facing speaker (410-2) output those different channels.

The computing device (550) may also include a servomechanism control module (416) to, when executed by the processor (401), control the servomechanisms (411) coupled to the first, rear-facing speaker (410-1) and the second, front-facing speaker (410-2) to orient the direction of output (FIGS. 1 and 2, 130-1, 130-2) of the first, rear-facing speaker (410-1) and the second, front-facing speaker (410-2) based on the AV data. The servomechanisms (411) are capable of moving the speakers (410-1, 410-2) in both the vertical and horizontal directions.

As described herein, the servomechanisms (411) may move the output (FIGS. 1 and 2, 130-1, 130-2) of the speakers (410-1, 410-2) in both the vertical and horizontal directions based on what is being presented on the display device (409). For example, in instances where a user may expect an object displayed at a periphery area of the display device (409) or is visually perceived off-screen at the top, bottom, or sides of the display device (409), and where the user is expecting the object to make noise associated with the action presented in the visual output (135) of the display device (109), the servomechanisms (411) may move the speakers (410-1, 410-2) horizontally and vertically to audibly and spatially match the visual output (135) of the display device (109). This provides a more dimensional auditory experience for the user above the flat two-dimensional audio provided by systems that lack the first, rear-facing speaker (410-1) and the servomechanisms (411) to move the speakers (410-1, 410-2).

The computing device (450) of the stereophonic sound system (500) may also include audio enhancement devices (412), and an audio enhancement module (418). Audio enhancement devices (412) may include, for example, an equalizer, a compressor, a limiter, a dynamic range control device, and combinations thereof. The audio enhancement module (418) provides any computer readable program code the audio enhancement devices (412) may use to execute their respective audio enhancement capabilities. Among the audio enhancement devices (412), an equalizer may be any device that adjusts the balance between frequency components within an electronic signal through the use of linear filters that filter the signal to make adjustments to the bass and treble of the signal. Further, among the audio enhancement devices (412), a compressor or dynamic range control device may be any device that reduces the volume of loud sounds or amplifies quiet sounds within the audio signal thus reducing or compressing the audio signal's dynamic range. In other words, the compressor or dynamic range control device compresses the audio signal to gain low levels of the audio signal and increase the overall loudness of the output of the speakers (410-1, 410-2). Still further, among the audio enhancement devices (412), a limiter is any device that allows signals below a specified input power or level to pass unaffected while attenuating (i.e., lowering) the peaks of stronger signals that exceed a threshold. Clipping is a type of limiting the limiter may perform.

Figure 6:
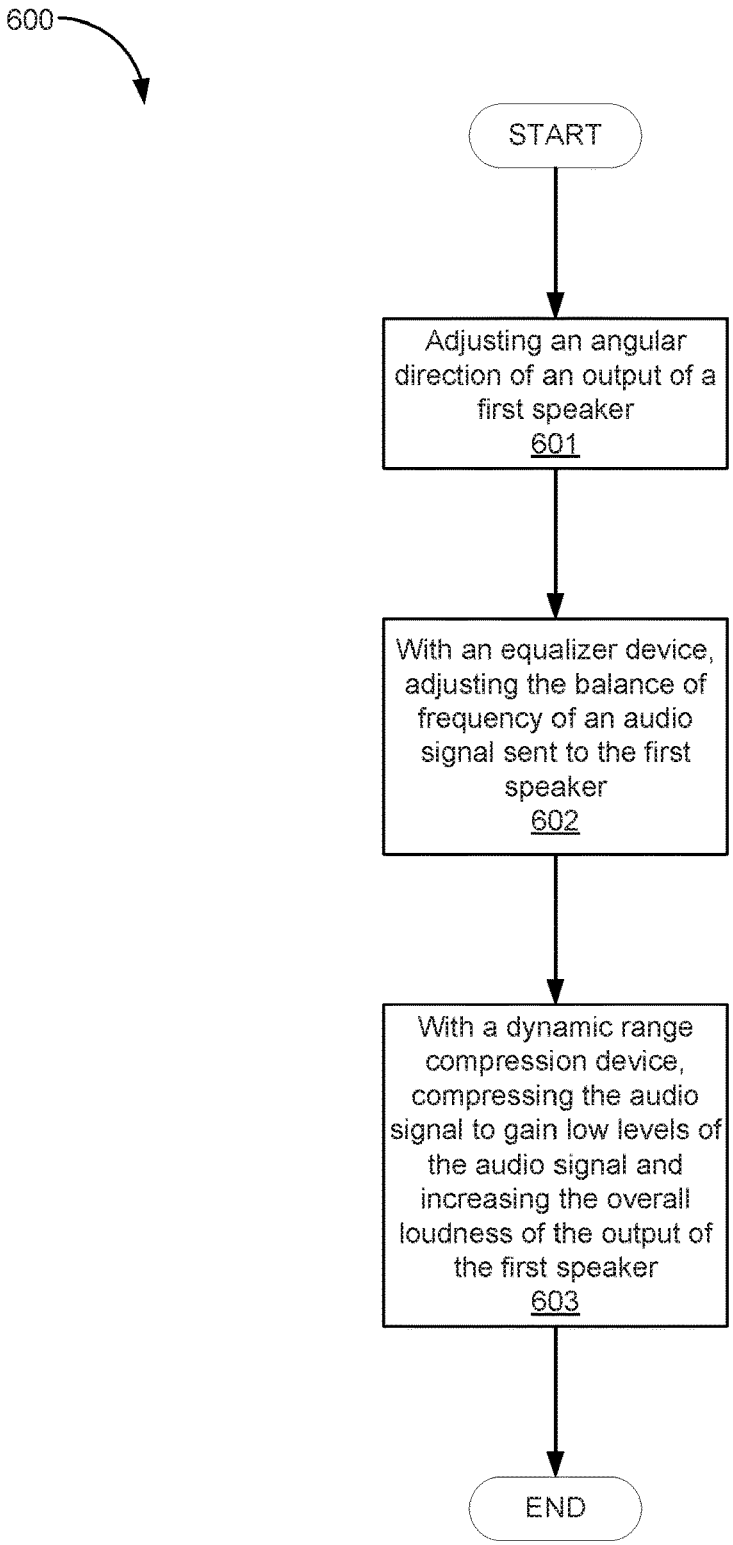
FIG. 6 is a flowchart showing a method of tuning a stereophonic sound system, according to an example of the principles described herein.

FIG. 6 is a flowchart showing a method (600) of tuning a stereophonic sound system (400, 500, collectively referred to herein as 400), according to an example of the principles described herein. The method may include adjusting (block 601) an angular direction of an output (130-1) of a first speaker (410-1). In this example, the first speaker is the rear-facing speaker (110-1).

The output software such as the audio enhancement module (418) may be tuned to optimize the sound output by the first speaker (110-1). Tuning of the audio enhancement module (418) may include, with an equalizer device, adjusting (block 602) the balance of frequency of the audio signal included in the AV data (415) sent to the first speaker (110-1). Further, tuning of the audio enhancement module (418) may include, with a dynamic range compression device, compressing (block 603) the audio signal included in the AV data (415) to gain low levels of the audio signal and increasing the overall loudness of the output of the first speaker (110-1).

Figure 7:
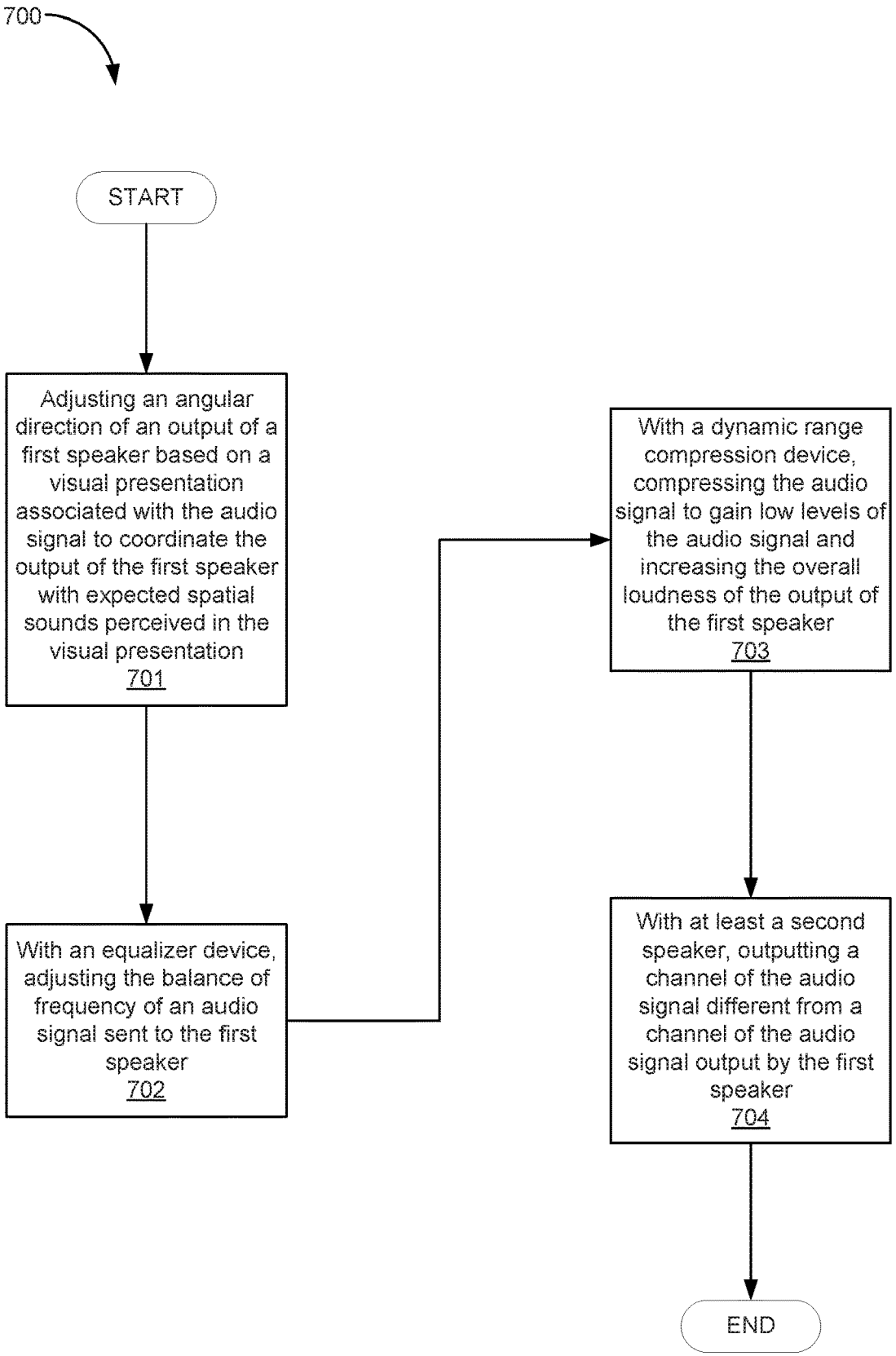
FIG. 7 is a flowchart showing a method of tuning a stereophonic sound system, according to an example of the principles described herein.

FIG. 7 is a flowchart showing a method (700) of tuning a stereophonic sound system (400), according to an example of the principles described herein. The method (700) includes adjusting (block 701) an angular direction of an output (130-1) of a first speaker (110-1) based on a visual presentation associated with the audio signal of the AV data (415) to coordinate the output (130-1) of the first speaker (110-1) with expected spatial sounds perceived in the visual presentation. The method (700) may also include, with an equalizer device included within the audio enhancement devices (412), adjusting (block 702) the balance of frequency of an audio signal of the AV data (415) sent to the first speaker (110-1). Further, with a dynamic range compression device included within the audio enhancement devices (412), the method may include compressing (block 703) the audio signal of the AV data (415) to gain low levels of the audio signal and increasing the overall loudness of the output of the first speaker.

The method (700) may also include, with at least a second speaker (110-2), outputting (block 704) a channel of the audio signal of the AV data (415) different from a channel of the audio signal output by the first speaker (110-2). The second speaker (110-2) may work in concert with the first speaker (110-1) to provide a surround sound effect to the audio output by the speakers (110-1, 110-2). Although the first speaker (110-1) and the second speaker (110-2) are depicted in the figures, any number of additional speakers may be used on connection with the first speaker (110-1) and the second speaker (110-2) to provide a different level of surround sound to the stereophonic sound systems (400) and associated devices described herein.

Figure 8:
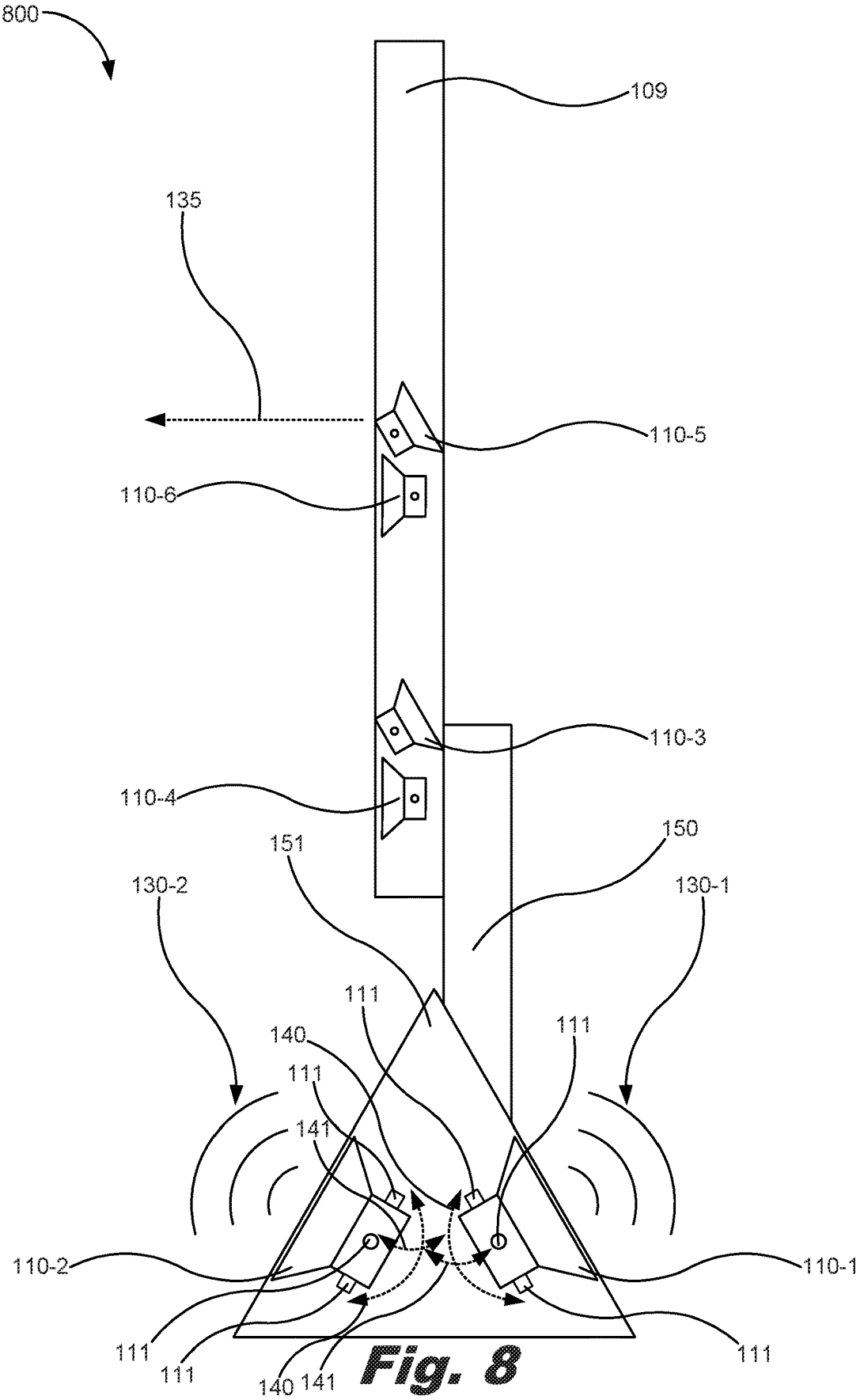
FIG. 8 is a diagram of a stereophonic device, according to an example of the principles described herein.
Figure 9:
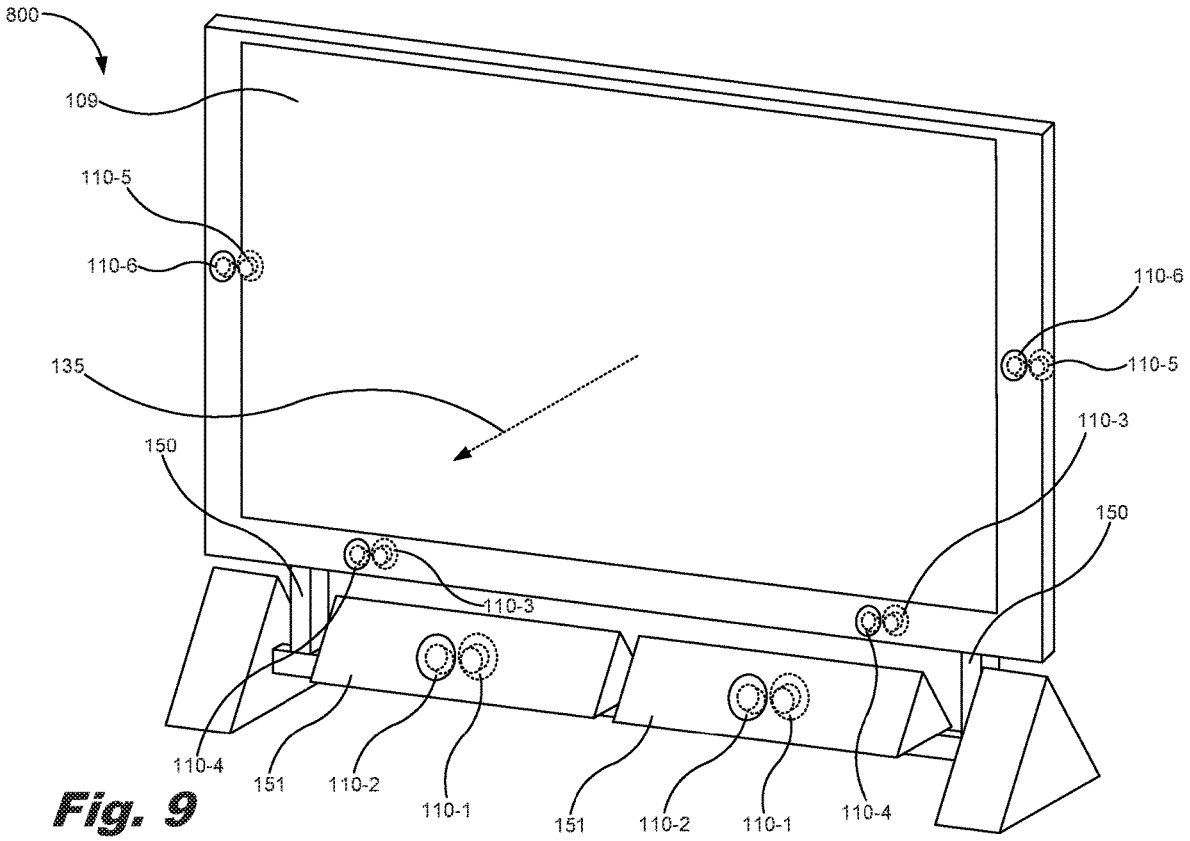
FIG. 9 is a perspective view of a stereophonic device, according to an example of the principles described herein.

FIG. 8 is a diagram of a stereophonic device (800), according to an example of the principles described herein. Further, FIG. 9 is a perspective view of the stereophonic device (800) of FIG. 8, according to an example of the principles described herein. The stereophonic device (800) of FIGS. 8 and 9 includes similar elements as the stereophonic devices (100, 200, 400, 500) of FIGS. 1 through 5, and description of these elements is provided herein in connection with FIGS. 1 through 5. The stereophonic device (800) of FIGS. 8 and 9 include pairs of first, rear-facing speakers (110-3, 110-5) and the second, front-facing speakers (110-4, 110-6) in addition to, or in one example, instead of the first, rear-facing speaker (110-1) and the second, front-facing speakers (110-2) housed within the housing (151). Thus, the stereophonic device (800) of FIGS. 8 and 9 may include the first, rear-facing speakers (110-3) and the second, front-facing speakers (110-4) included at the bottom of the display device (109), the first, rear-facing speakers (110-5) and the second, front-facing speakers (110-6) included at the sides and middle of the display device (109), the first, rear-facing speaker (110-1) and the second, front-facing speakers (110-2) housed within the housing (151), and combinations thereof. Each speaker (110) may output the same channel of audio, different channels of audio, or combinations thereof.

The first, rear-facing speakers (110-3, 110-5) and the second, front-facing speakers (110-4, 110-6) may be moveable via servomechanisms (111) as described in connection with speakers (110-1, 110-2). Further, in one example, the first, rear-facing speakers (110-3, 110-5) and the second, front-facing speakers (110-4, 110-6) may be independently activatable. For example, the activation of the first, rear-facing speaker (110-3) and the second, front-facing speaker (110-4) included at the bottom of the display device (109) may be performed when the audio signal is to be coordinated with the output of the speakers (110-3, 110-4) with expected spatial sounds perceived in the visual presentation presented on the display device (109) where the user is expecting the sound to come from the bottom of the display device (109). Similarly, the first, rear-facing speakers (110-5) and the second, front-facing speakers (110-6) included at the sides and middle of the display device (109) may be activated when the user is expecting the audio to come from a middle portion of the visual presentation presented on the display device (109). The examples of FIGS. 8 and 9 provide for a more dynamic placement and output of audio signals to provide the user with a more immersive audio-visual experience.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processor (401) of the computing device (450, 550) of the stereophonic sound systems (400) described herein, or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a stereophonic device. The stereophonic device includes a first speaker to output audio associated with the visual presentation. The output of the first speaker is directed in a direction opposite the visual output of a display device. The stereophonic device includes a servomechanism to adjust an angular direction of an output of a first speaker based on a visual presentation presented on a display device associated with the audio signal to coordinate the output of the first speaker with expected spatial sounds perceived in the visual presentation.

The stereophonic devices, systems and methods described herein provides greater sound depth and dimension, and provides spatial perception of the audio signal as relates to a video signal of AV data presented via the stereophonic device. Further, the present devices, systems, and systems provide for the adjustment of the vertical and horizontal direction of the sound as presented by both front- and back-facing speakers. In this manner, the spatial perception of the sound output by the speakers may be matched with the visual components to provide a user with a greater sense of realism and immersion in the presentation of the AV data.

The preceding description has been presented to illustrate and describe examples of the principles described. This description is not intended to be exhaustive or to limit these principles to any precise form disclosed. Many modifications and variations are possible in light of the above teaching.

What is claimed is:

1. A stereophonic device, comprising:

a first speaker to output audio associated with a visual presentation, the output of the first speaker being directed in a direction opposite the visual output of a display device;

a servomechanism to adjust a vertical angular direction of an output of a first speaker based on a region of the visual presentation presented on a display device from where the audio is perceived to originate to coordinate the output of the first speaker with expected spatial sounds perceived in the visual presentation.

2. The stereophonic device of claim 1, wherein the servomechanism adjusts a horizontal angular direction of the output of the first speaker based on the visual presentation presented on the display device associated with the audio signal to coordinate the output of the first speaker with expected vertical spatial sounds perceived in the visual presentation.

3. The stereophonic device of claim 1, comprising a dynamic range compression device to compress the audio signal to gain low levels of the audio signal and increase the overall loudness of the output of the first speaker.

4. The stereophonic device of claim 1, comprising an equalizer device to adjust the balance of frequency of the audio signal sent to the first speaker.

5. The stereophonic device of claim 1, comprising at least a second speaker to output a channel of the audio signal different from a channel of the audio signal output by the first speaker.

6. The stereophonic device of claim 5:

further comprising a second servomechanism to adjust an angular direction of an output of the second speaker; and wherein the first speaker is independently actuatable relative to the second speaker.

7. The stereophonic device of claim 1, wherein the first speaker is behind the visual output of the display device.

8. A stereophonic sound system, comprising:

a computing device comprising:

a processor; and a data storage device communicatively coupled to the processor;

a display device communicatively coupled to the computing device, the display device to, when activated by the processor, display a visual presentation;

a first speaker to output audio associated with the visual presentation, the output of the first speaker being directed in a direction opposite the visual presentation of the display device; and a servomechanism to adjust a vertical angular direction of an output of the first speaker based on a region of the visual presentation from where the audio is perceived to originate and based on visual data associated with the audio signal of AV data passed to the display device and first speaker to coordinate the output of the first speaker with expected spatial sounds perceived in the visual presentation.

9. The stereophonic sound system of claim 8, comprising an equalizer device to adjust the balance of frequency of the audio signal sent to the first speaker.

10. The stereophonic sound system of claim 8, comprising a dynamic range compression device to compress the audio signal to gain low levels of the audio signal and increase the overall loudness of the output of the first speaker.

11. The stereophonic sound system of claim 8, comprising at least a second speaker to output a channel of the audio signal different from a channel of the audio signal output by the first speaker.

12. The stereophonic sound system of claim 8, wherein the servomechanism adjusts the angular direction of the output of the first speaker in a horizontal angular direction.

13. The stereophonic sound system of claim 8, wherein the first speaker is disposed within a housing of the display device.

14. The stereophonic sound system of claim 8, wherein the first speaker is disposed within a housing of a support of the display device.

15. The stereophonic sound system of claim 8, wherein:

the angular direction of the output is directed upward responsive to an object presented at a top of the display device generating a noise; and the angular direction of the output is directed downward responsive to an object presented at a bottom the display device generating the noise.

* * * * *